US005233935A

United States Patent [19]

Winter

[11] Patent Number: 5,233,935

[45] Date of Patent: Aug. 10, 1993

[54] LOOPER THROW-OUT SAFETY CATCH DEVICE

[75] Inventor: Frank F. Winter, Prospect Heights, Ill.

[73] Assignee: Union Special Corporation, Huntley, Ill.

[21] Appl. No.: 884,069

[22] Filed: May 15, 1992

[51] Int. Cl.[5] ..... D05B 57/00; D05B 85/00

[52] U.S. Cl. ..... 112/199; 112/200; 112/261

[58] Field of Search ..... 112/80.5, 80.52, 163, 112/166, 167, 168, 197, 199, 200, 258, 259, 261, 274; 192/129 R, 129 A, 133, 135, 138

[56] References Cited

U.S. PATENT DOCUMENTS

| | | | |
|---|---|---|---|
| 1,912,959 | 6/1933 | Zeier et al. | 112/199 |
| 2,211,619 | 8/1940 | Hacklander et al. | 112/200 |
| 2,391,519 | 12/1945 | Smith | 112/200 |
| 2,946,301 | 7/1960 | Hacklander | 112/200 |
| 3,141,427 | 7/1964 | Gross | 112/200 |
| 3,867,891 | 2/1975 | Grabher | 112/166 |
| 4,091,754 | 5/1978 | Onembo | 112/200 |
| 4,498,405 | 2/1985 | Hanyu et al. | 112/261 X |
| 4,649,841 | 3/1987 | Koshinaka | 112/199 X |
| 4,671,195 | 6/1987 | Wolff et al. | 112/199 |
| 4,693,194 | 9/1987 | Buzzi | 112/199 |

FOREIGN PATENT DOCUMENTS

| | | | |
|---|---|---|---|
| 0901861 | 11/1953 | Fed. Rep. of Germany | 112/200 |

*Primary Examiner*—Clifford D. Crowder
*Assistant Examiner*—Ismael Izaguirre
*Attorney, Agent, or Firm*—Willian Brinks Olds Hofer Gilson & Lione

[57] ABSTRACT

A looper throw-out device containing a latch for catching the release lever of the looper throw-out device when the release lever is left in the unlocked position. The latch is mounted on the inside portion of the sewing machine cover. If an operator fails to lock the release lever before sewing, the latch catches the unlocked release lever when the operator attempts to close the sewing machine cover.

7 Claims, 3 Drawing Sheets

LOOPER THROW-OUT SAFETY CATCH DEVICE

BACKGROUND OF THE INVENTION

1. Field of the Invention

The invention relates to a lever actuated looper throw-out device for a sewing machine employing one or more sewing needles and loopers. More particularly, the invention relates to a safety catch device that prevents improper operation of, and damage to, a sewing machine employing a looper throw-out device.

2. Background Information

Sewing machines employ one or more stitching needles and loopers, and an operator must often access the loopers for threading. To access the looper, the operator opens a cover on the sewing machine and disengages a looper holder from its sewing position by using a looper throw-out device.

A looper throw-out device, such as the one disclosed in U.S. Pat. No. 4,671,195, includes a release lever which disengages the looper holder. To thread the loopers, the sewing machine operator manually unlocks the release lever thereby and then pulls the looper holder out from under the sewing area. This provides the operator with the necessary space to thread the loopers. Once the operator is through threading the loopers, the operator must reengage the looper holder into the sewing position and then must lock the looper holder in place with the release lever. When the release lever is properly relocked, the looper holder is securely held in the sewing position.

At times, an operator will fail to lock the release lever before starting the sewing operation, and the sewing machine will be damaged by the unsecured looper holder or release lever. The looper throw-out device, the loopers and the stitching needles may be severely damaged. Moreover, the machine will tend to skip stitches and the thread will break.

This invention overcomes this problem by employing a device that prevents the operator from closing the cover of the sewing machine if the looper holder has not been secured in place by interlocking with the release lever. When the cover cannot be closed, this serves as a signal to the operator that the release lever of the looper throw-out has not been properly locked.

SUMMARY OF THE INVENTION

The invention comprises a means for catching or interlocking with the release lever, such as a hook-shaped device, that prevents the cover from being closed when the release lever is not locked. Preferably, the catching means is mountable on the inside of a swing-down cover. When the swing-down cover is open and the release lever is unlocked, the release lever rests on the inside of the cover. If the operator attempts to close the cover before locking the release lever, the device catches or traps the release lever and prevents the cover from being closed. This serves as a signal to the operator that the release lever is not locked.

In another embodiment, a stop is attached to the release lever to prevent the operator from forcing the lever past its normal clamping position thereby preventing interference with the bed casting of the sewing machine.

BRIEF DESCRIPTION OF THE DRAWINGS

FIG. 3(*b*) shows a second latch plate configuration for the present invention.

FIG. 4(*b*) shows the release lever of FIG. 4(*a*) in a transverse perspective.

DESCRIPTION OF THE PREFERRED EMBODIMENTS

The invention may be used on any sewing machine that uses a lever actuated looper throw-out device that is arranged on a shaft for pivotal movement. Such sewing machines include any machine employing one or more sewing needles and loopers, such as the two and three needle 401 stitch F600 class flatbed sewing machines and the XF 500 sewing machine available from Union Special Corporation.

Figure 1:
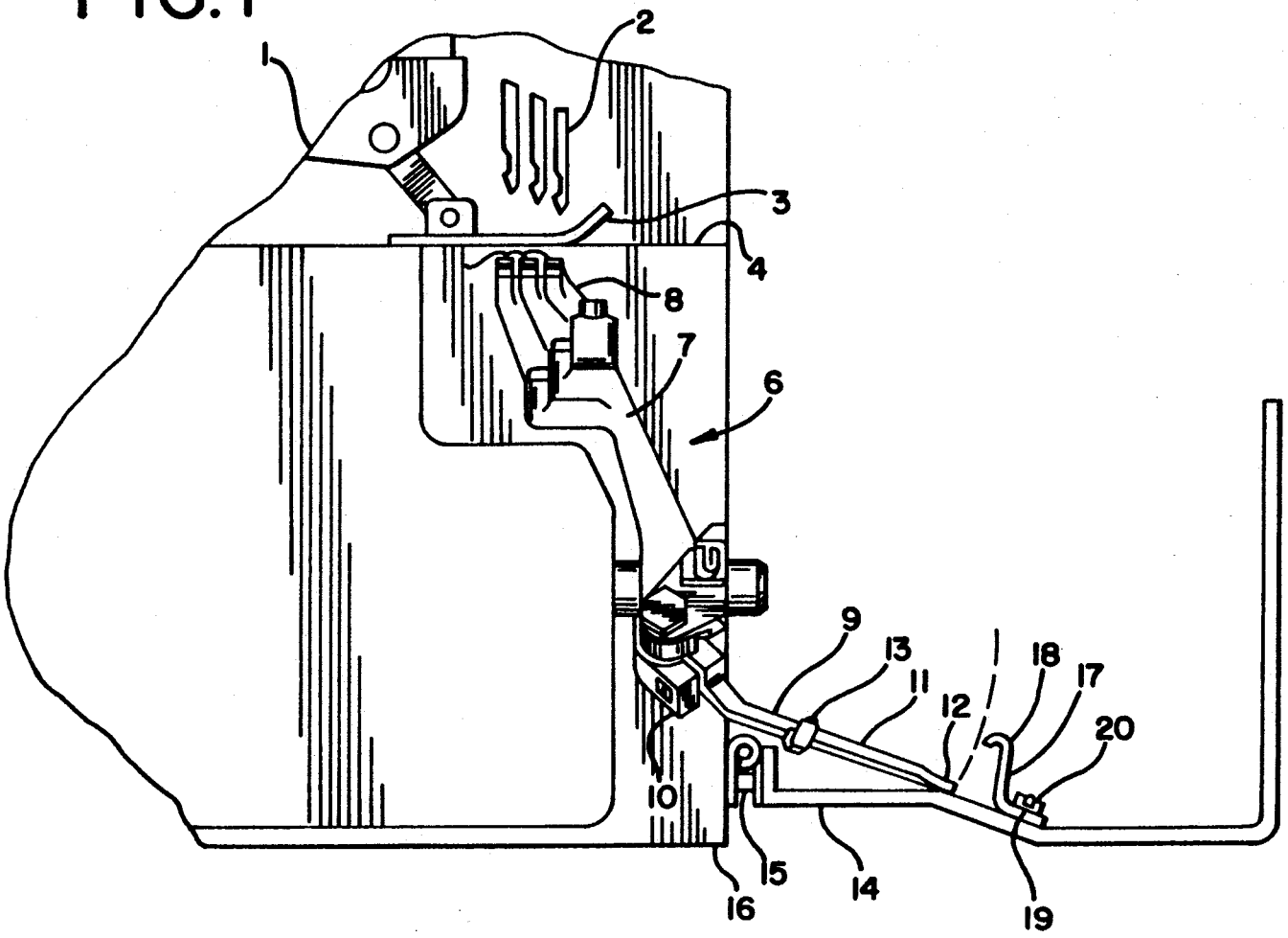
FIG. 1 shows a looper throw-out device with a safety catch in a sewing machine with a swing-down cover open.
Figure 2:
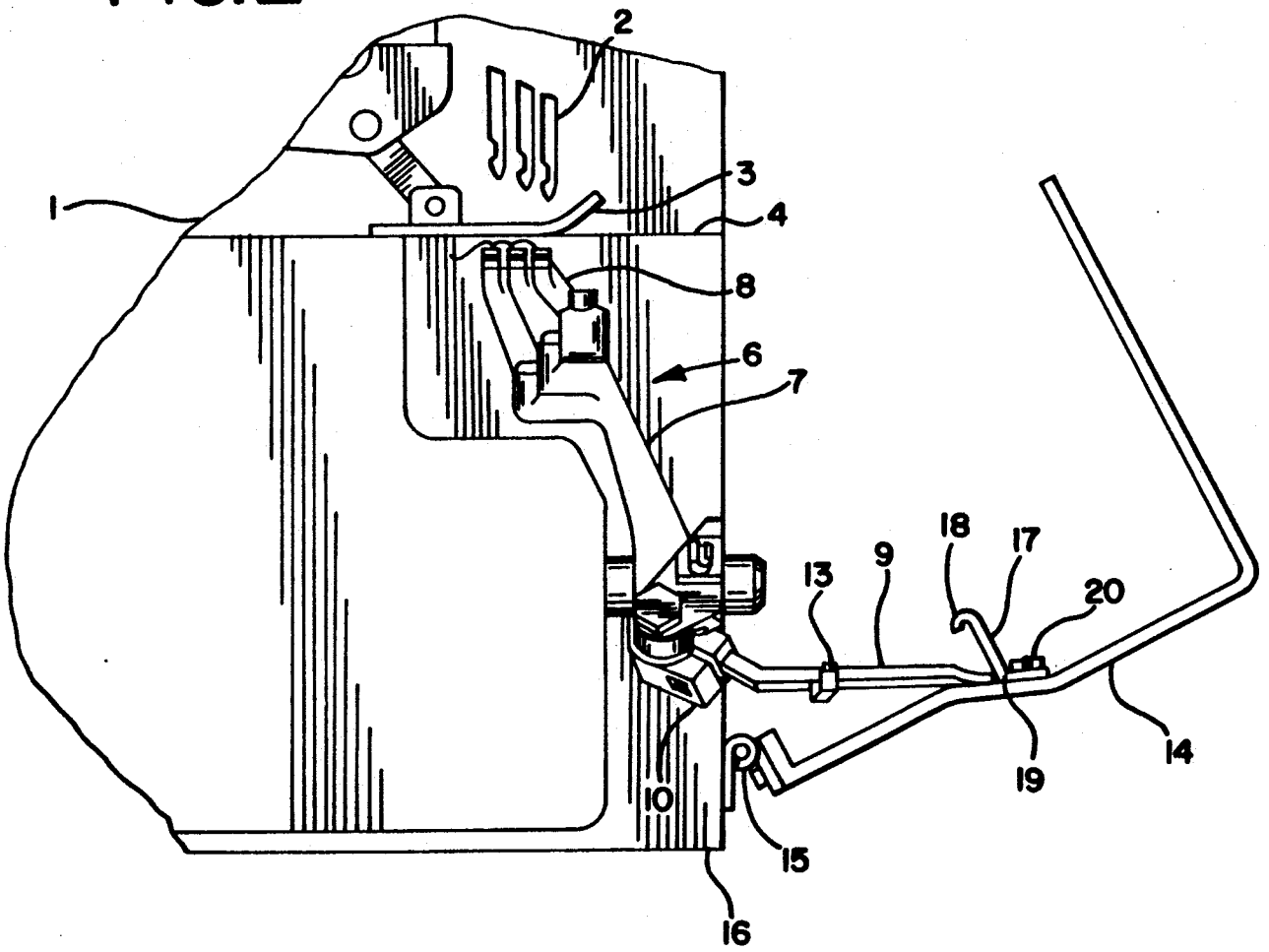
FIG. 2 shows a looper throw-out device with a safety catch in a sewing machine with a swing-down cover partially closed.
Figure 3A:
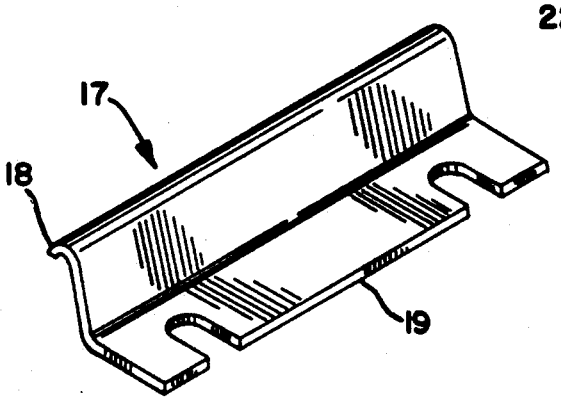
FIG. 3(*a*) shows a first latch plate configuration for the present invention.
Figure 3B:
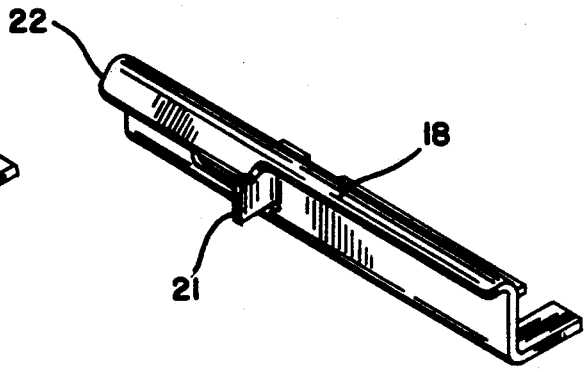

FIGS. 1 and 2 show portions of a multiple needle sewing machine 1 that are relevant to this invention. The upper part of the sewing machine contains a plurality of sewing needles 2 arranged over a presser foot 3 which bears against a throat plate 4. Below the throat plate 4 is a looper throw-out device 6, containing a looper holder 7, which supports loopers 8, and a release lever 9. The release lever 9 contains an arm 11, a stop 13 and a tip 12, and is joined to the base of the looper holder 7 by a binder clamp portion 10. A swing-down cover 14 is attached to the outside casing 16 of the sewing machine by hinges 15. A latch 17 containing an inwardly facing hook portion 18 at the upper end is attached to the inside area of the swing-down door 14 at a base 19 by screws 20. FIG. 3(*a*) and 3(*b*) show two latch configurations that may be used in the invention. FIG. 3*a* shows a latch 17 that is elongated into a plate and contains a hook or C-shaped edge 18 and an elongated base 19. FIG. 3*b* shows a latch with an additional tab 21 located below an extended portion 22 of the hook-shaped edge 18. This latch configuration is required for certain sewing machines where the release lever lays at an angle to the latch plate. Such machines include the XF500 sewing machine currently available from Union Special Corporation.

The latches provide means for catching the release lever. Additional such means include any design of hook, catch, latch or clasp that will trap or ensnare the unlocked release lever when the operator attempts to close the swing-down cover. Thus, the latch may be notched, and may contain various channels or troughs for catching and ensnaring the release lever. The catching means may consist of one elongated latch plate, as shown in FIG. 3, or a plurality of smaller latches. The catching means may be mounted in any location that will alert the operator that the release lever has not been properly locked into place, and are preferably mounted on the inside portion of the sewing machine cover that provides access to the looper.

Preferably, the latch is located on the inside cover at a location sufficient to allow the tip 12 of the release lever 9 to touch the inside portion of the cover when the release lever is unlocked. If the latch is located too close to the sewing area, the unlocked release lever will touch the top 18 of the latch 17. Thus, when the operator properly engages the looper holder into the sewing position and closes the open cover, the latch 17 pushes the unlocked release lever to a partially locked position. In this case, the risk of damage to the sewing machine is also substantially reduced since the looper holder 7 is partially locked in place and a rubbing noise caused by the partially locked release lever 9 touching the top 18 of the latch 17 reminds the operator that the release lever should be completely locked in place.

The sewing machine is properly operated with the looper holder engaged into the sewing position, the release lever locked into place and the sewing machine cover closed. The release lever is locked by pushing it into place. To access the looper threads, the operator opens the front cover of the sewing machine and unlocks the release lever by pulling the lever forward and by pulling the looper holder from under the sewing area and into the threading position.

FIG. 1 shows a sewing machine cover, known as a swing-down cover 14, open and the release lever 9 unlocked. When unlocked, the end 12 of the release lever 9 lies on the inside area of the swing-down cover 14 and points toward the latch 17. When access to the looper threads is no longer required, the operator pushes the looper holder into the sewing position and relocks the release lever 9 before closing the swing-down cover 14. If the operator fails to lock the release lever 9 before closing the swing-down cover 14, the latch 17 will catch or trap the end 12 of the release lever 9 as the operator attempts to close the swing-down cover 14.

FIG. 2 shows a latch 17 catching the unlocked release lever 9 when the swing-down cover 14 is partially closed. The sudden stop of the swing-down door 14, caused by the latch 17 catching the release lever 9, will remind the operator that the release lever 9 must be locked back into the sewing position before beginning a sewing operation.

For additional protection of the sewing machine, a stop 13 may be affixed to the release arm 9. The stop prevents the operator from forcing the release lever too far to the rear of the sewing machine when relocking. The stop prevents the release lever from interfering with the vertical wall of the sewing machine base.

Figure 4A:
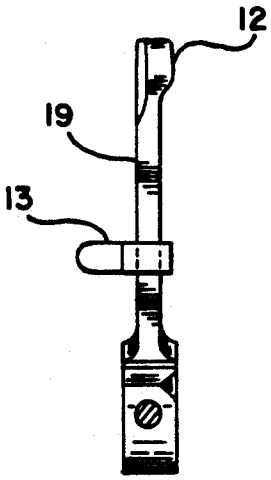
FIG. 4(*a*) shows a release lever containing a stop.
Figure 4B:
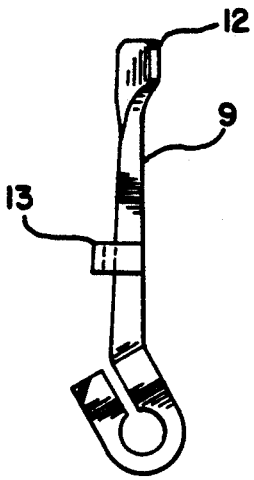

FIGS. 4(*a*) and 4(*b*) show a release lever 9 having a stop 13. The stop 13 can be any type of metal or plastic that will prevent the release lever from being forced into the wrong position. The stop 13 may be shaped as a tab and is stably affixed to the release lever. The stop 13 may be welded or glued to the release lever 9 or may be casted with the release lever during manufacture. The stop 13 prevents the release lever 9 from being forced into the wrong position by bearing against the front side of the looper holder.

It is to be understood that the above description and drawings are intended to describe embodiments of the invention. The full scope of the invention is covered by the appended claims.

I claim:

1. A looper throw-out device for a sewing machine comprising a looper and a cover, said device comprising:

holding means for holding the looper;

a release lever attached to said looper holding means, said release lever having a locked position and an unlocked position; and catching means for catching said release lever when said release lever is in the unlocked position, said catching means being attached to an inside portion of said cover.

2. The throw-out device of claim 1 wherein the catching means comprises a hook-shaped latch.

3. The throw-out device of claim 1 further comprising a stop means for bearing against the looper holder when the release lever is in the locked position, said stop means being affixed to the release lever.

4. A looper throw-out safety catch device for a sewing machine comprising a swing cover, said device comprising:

means for holding a looper;

a release lever attached to said looper holding means, said release lever having a locked position and an unlocked position; and a hook-shaped latch for catching said release lever when said release lever is in the unlocked position, said latch being located on the inside of the cover.

5. A sewing machine comprising:

at least one sewing needle;

at least one looper;

a looper holder;

a swing cover to provide access to said at least one looper;

a release lever attached to said looper holder, said release lever having a locked and an unlocked position;

catching means for catching said release lever when said release lever is in the unlocked position, said catching means being mounted on an inside area of said cover.

6. The sewing machine of claim 5 wherein said catching means comprises a hook-shaped latch.

7. The sewing machine of claim 5 comprising a stop means for bearing against the looper holder when the release lever is in the locked position, said stop means being affixed to the release lever.

* * * * *